US008684285B2

(12) United States Patent
Imai

(10) Patent No.: US 8,684,285 B2
(45) Date of Patent: Apr. 1, 2014

(54) FUEL INJECTION VALVE

(75) Inventor: Keita Imai, Kariya (JP)

(73) Assignee: Denso Corporation, Kariya (JP)

( * ) Notice: Subject to any disclaimer, the term of this patent is extended or adjusted under 35 U.S.C. 154(b) by 321 days.

(21) Appl. No.: 13/239,920

(22) Filed: Sep. 22, 2011

(65) Prior Publication Data

US 2012/0080542 A1 Apr. 5, 2012

(30) Foreign Application Priority Data

Oct. 5, 2010 (JP) ..... 2010-225457
Jun. 29, 2011 (JP) ..... 2011-144056

(51) Int. Cl.
*B05B 1/30* (2006.01)

(52) U.S. Cl.
USPC ..... 239/533.14; 239/585.5

(58) Field of Classification Search
CPC ..... B05B 1/30; B05B 1/3046
USPC ..... 239/585.1, 585.3, 585.4, 585.5, 533.2, 239/533.9, 533.12, 584, 533.14
See application file for complete search history.

(56) References Cited

U.S. PATENT DOCUMENTS 5,263,648 A * 11/1993 Vogt et al. ..... 239/585.4
5,544,816 A * 8/1996 Nally et al. ..... 239/585.5
5,881,957 A * 3/1999 Mizuno et al. ..... 239/533.2
6,279,873 B1 8/2001 Eichendorf et al.
6,616,072 B2 * 9/2003 Harata et al. ..... 239/533.12
6,708,904 B2 * 3/2004 Itatsu ..... 239/533.12
2008/0276907 A1 11/2008 Abe et al.
2008/0277505 A1 11/2008 Hoang
2009/0159729 A1 6/2009 Yoshimaru et al.

OTHER PUBLICATIONS

Office Action (6 pages) dated Oct. 28, 2013, issued in corresponding Chinese Application No. 201110305125.1 and English translation (4 pages).

* cited by examiner

*Primary Examiner* — Davis Hwu
(74) *Attorney, Agent, or Firm* — Nixon & Vanderhye PC

(57) ABSTRACT

A movable core includes a through-hole, which receives a main body of a needle therethrough, and a receiving recess, which is axially recessed in a stationary core side end surface of the movable core. The receiving recess is configured into an annular form and radially outwardly extends from the through-hole to receive a flange of the needle. A movable plate is placed on an axial side of the movable core, which is opposite from the nozzle. An axial length of the flange is smaller than an axial distance between a contact surface of the movable plate, which is contactable with the needle, and a bottom wall of the receiving recess in a contact state where the movable core and the movable plate contact with each other.

11 Claims, 12 Drawing Sheets

FUEL INJECTION VALVE

CROSS REFERENCE TO RELATED APPLICATION

This application is based on and incorporates herein by reference Japanese Patent Application No. 2010-225457 filed on Oct. 5, 2010 and Japanese Patent Application No. 2011-144056 filed on Jun. 29, 2011.

BACKGROUND OF THE INVENTION

1. Field of the Invention

The present invention relates to a fuel injection valve.

2. Description of Related Art

In a known fuel injection valve, an urging member is provided on a valve seat side of a movable core, through which a needle is received, to improve a response of the needle. In Japanese Unexamined Patent Publication JP2009-150346A (corresponding to US20090159729A1), the movable core is provided on a side of a flange of the needle, which is on the valve seat side. A first urging member, which urges the needle and the movable core in a valve closing direction toward a fuel injection hole, is provided on an opposite side of the flange of the needle, which is opposite from the valve seat. A second urging member, which urges the movable core and the needle in a valve opening direction, is provided on the valve seat side of the movable core. In such a fuel injection valve, the movable core is urged back by the second urging member upon compression of the second urging member by the movable core to possibly cause collision of the movable core against the flange of the needle, which is held in a valve closed state for closing the fuel injection hole with the needle. This collision of the movable core against the flange of the needle may possibly cause lifting of the needle away from the fuel injection hole to cause undesirable secondary valve opening of the injection hole.

Furthermore, Japanese Unexamined Patent publication JP2008-506875A (corresponding to US2008/0277505A1) teaches another fuel injection valve, in which an acceleration distance (prestrike gap) is provided between a movable core (armature) and a first flange (a flange of a needle). However, in this fuel injection valve, the first flange and a second flange need to be welded to the needle, and a sleeve needs to be welded to the movable core. Therefore, the number of components and the welding spots are disadvantageously increased, and the assembling of the fuel injection valve becomes more complicated. Furthermore, the welded portion between the first flange and the needle may possible be influenced by, for example, thermal deformation to possibly cause a change in the acceleration distance.

SUMMARY OF THE INVENTION

The present invention is made in view of the above disadvantages.

According to the present invention, there is provided a fuel injection valve, which includes a housing, a nozzle, a stationary core, a needle, a movable core, a movable plate, a first urging member, a second urging member and a coil. The housing is configured into a tubular form. The nozzle is located at one end portion of the housing and includes a fuel injection hole and a valve seat. The stationary core is held in an inside of the housing and is configured into a tubular form. The needle is received in the housing and is adapted to reciprocate in an axial direction. The needle includes a main body and a flange. The main body is configured into an elongated rod form and has a sealing portion, which is formed at one end portion of the main body and is seatable against the valve seat. The flange radially outwardly extends from the other end portion of the main body, which is opposite from the one end portion of the main body. The needle opens the fuel injection hole when the sealing portion is lifted away from the valve seat in an opening direction. The needle closes the fuel injection hole when the sealing portion is seated against the valve seat in a closing direction, which is axially opposite from the opening direction. The movable core is axially placed between the stationary core and the nozzle in the inside of the housing and is adapted to reciprocate in the axial direction. The movable core includes a through-hole and a receiving recess. The through-hole axially extends through the movable core and receives the main body of the needle therethrough. The receiving recess is axially recessed in a stationary core side end surface of the movable core located on an axial side where the stationary core is placed. The receiving recess is configured into an annular form and radially outwardly extends from the through-hole to receive the flange of the needle. The movable plate is placed on an axial side of the movable core, which is opposite from the nozzle. An outer diameter of the movable plate is larger than an inner diameter of the receiving recess, and the movable plate is contactable with the movable core and the needle. The first urging member urges the movable plate to urge the movable core in the closing direction. The second urging member has an urging force, which is smaller than an urging force of the first urging member. The second urging member urges the movable core to urge the movable plate in the opening direction. The coil generates a magnetic force upon receiving an electric power to magnetically attract the movable core toward the stationary core side. An axial length of the flange is smaller than an axial distance between a contact surface of the movable plate, which is contactable with the needle, and a bottom wall of the receiving recess in a contact state where the movable core and the movable plate contact with each other in the axial direction.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

Figure 1:
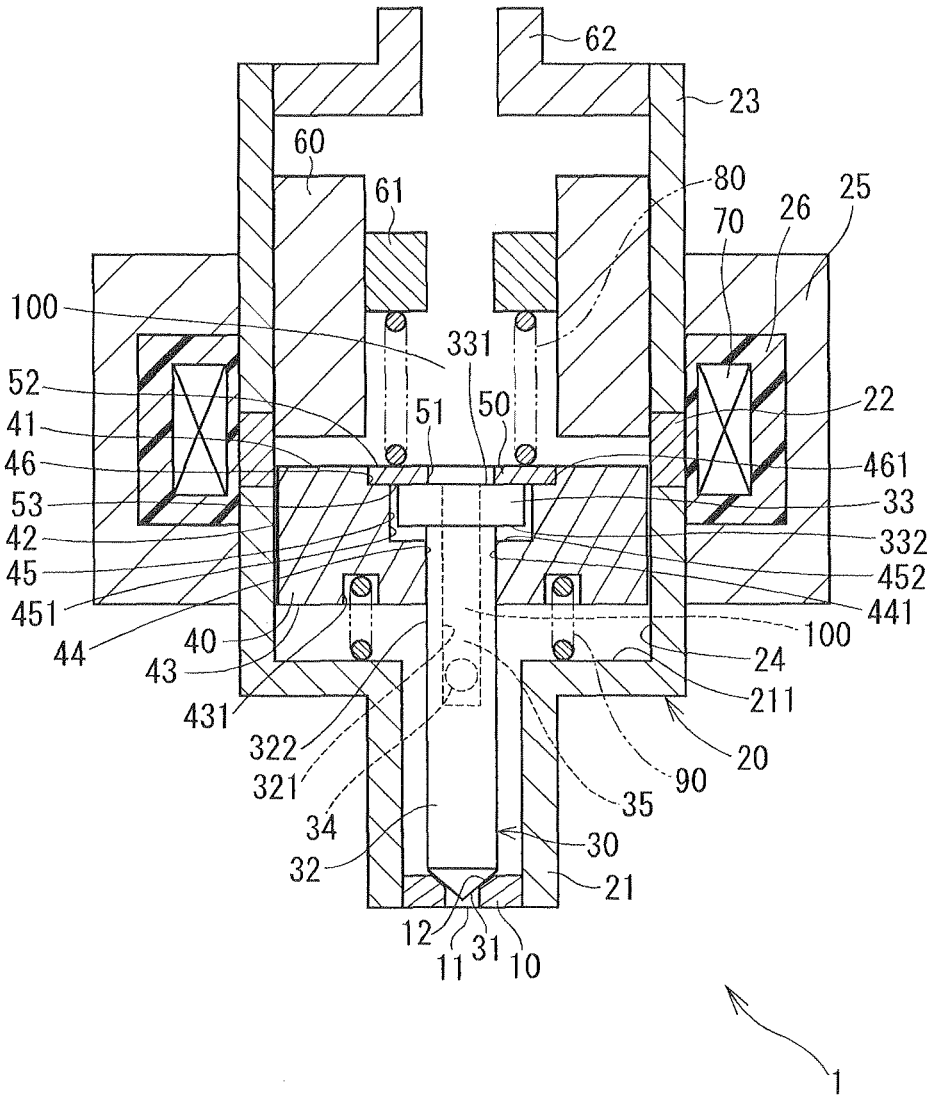
FIG. 1 is a schematic cross-sectional view showing a structure of a fuel injection valve according to a first embodiment of the present invention.

Various embodiments of the present invention will be described with reference to the accompanying drawings. In the following embodiments, similar components will be indicated by the same reference numerals and will not be described redundantly for the sake of simplicity. Also, components, which have a similar function, will be indicated by a common component name throughout the following embodiments.

First Embodiment

FIG. 1 shows a fuel injection valve 1 according to a first embodiment of the present invention. The fuel injection valve 1 is installed in an internal combustion engine (not shown) and injects fuel in the internal combustion engine.

The fuel injection valve 1 includes a housing 20, a nozzle 10, a stationary core 60, a movable core 40, a needle 30, a movable plate 50, a first spring (serving as a first urging member) 80, a second spring (serving as a second urging member) 90 and a coil 70.

As shown in FIG. 1, the housing 20 includes a first tubular member 21, a second tubular member 22, a third tubular member 23, an outer peripheral member 25 and a molded resin portion 26. The first tubular member 21, the second tubular member 22 and the third tubular member 23 are respectively configured into a generally cylindrical tubular form and are coaxially joined together in this order. The outer peripheral member 25 contacts an outer peripheral surface of the first tubular member 21 and an outer peripheral surface of the third tubular member 23.

The first tubular member 21, the third tubular member 23 and the outer peripheral member 25 are made of a magnetic material, such as ferritic stainless steel, and are magnetically stabilized through a magnetic stabilization process. The second tubular member 22 is made of a non-magnetic material, such as austenitic stainless steel.

The nozzle 10 is installed to an end portion of the first tubular member 21 of the housing 20, which is axially opposite from the second tubular member 22. The nozzle 10 is made of a metal material, such as martensitic stainless steel. The nozzle 10 is quenched to have a predetermined rigidity.

In the present embodiment, the nozzle 10 is configured into a generally circular plate body. A fuel injection hole 11 is formed in a center part of the nozzle 10 to extend through the nozzle 10 in a thickness direction (axial direction) of the nozzle 10, which is generally perpendicular to a plane of the nozzle 10. An annular valve seat 12 is formed in an inner end surface of the nozzle 10 to circumferentially surround the fuel injection hole 11. The nozzle 10 is connected to the first tubular member 21 such that an outer peripheral wall of the nozzle 10 is fitted to an inner peripheral wall of the first tubular member 21. A connection between the nozzle 10 and the first tubular member 21, which are fitted together, is welded.

The stationary core 60 is made of a magnetic material, such as ferritic stainless steel, and is configured into a generally cylindrical tubular form. The stationary core 60 is magnetically stabilized through the magnetic stabilization process. The stationary core 60 is provided in an inside of the housing 20. The stationary core 60 and the third tubular member 23 of the housing 20 are welded together.

The needle 30 is made of a metal material, such as martensitic stainless steel, and is configured into an elongated rod form.

The needle 30 is received in the housing 20 such that the needle 30 is adapted to reciprocate in the axial direction in the housing 20. A sealing portion 31, which is seatable against the valve seat 12, is formed in an end portion of a main body 32 of the needle 30. The main body 32 of the needle 30 is configured into an elongated rod form and is located adjacent to the nozzle 10. The needle 30 has a flange 33. The flange 33 radially outwardly extends from an end portion of the needle 30, which is axially opposite from the nozzle 10, toward the inner peripheral wall 24 of the housing 20. In the present embodiment, the flange 33 is configured into a generally circuit disk form. The needle 30 is adapted to open or close the fuel injection hole 11 when the sealing portion 31 is lifted from or seated against the valve seat 12. Hereinafter, a moving direction of the needle 30 away from the valve seat 12 will be referred to as a valve opening direction (or simply referred to as an opening direction), and an opposite moving direction of the needle 30 toward the valve seat 12 will be referred to as a valve closing direction (or simply referred to as a closing direction). The flange 33 side part of the main body 32 is configured into a hollow tubular form, and a radial hole 34 is formed in the main body 32 to radially connect between an inner peripheral wall 321 and an outer peripheral wall 322 of the main body 32.

The movable core 40 is made of a magnetic material, such as ferritic stainless steel, and is configured into a generally cylindrical tubular form. The movable core 40 is magnetically stabilized through the magnetic stabilization process. In this instance, a hard coating is formed in an end surface (also referred to as a stationary core side end surface) 41 of the movable core 40, which is located on the stationary core 60 side, through a hard coating process.

The movable core 40 is placed in the inside of the housing 20 such that the movable core 40 is adapted to axially reciprocate between the stationary core 60 and the nozzle 10. A through-hole 44 is formed to axially extend through a center part of the movable core 40. An inner peripheral wall 441 of the through-hole 44 of the movable core 40 and the outer peripheral wall 322 of the main body 32 of the needle 30 are slidable relative to each other, and an outer peripheral wall 42 of the movable core 40 and an inner peripheral wall 24 of the housing 20 are slidable relative to each other. In this way, the movable core 40 is adapted to axially reciprocate in the inside of the housing 20 such that the movable core 40 slides relative to the needle 30 and the housing 20.

The movable core 40 includes a receiving recess 45 formed in the end surface 41 of the movable core 40 located on the stationary core 60 side such that the receiving recess 45 is axially recessed in the end surface 41 of the movable core 40.

The receiving recess 45 is configured into an annular form and radially outwardly extends from the inner peripheral wall 441 of the through-hole 44. The movable core 40 further includes a fitting groove 46 in the end surface 41 of the movable core 40 located on the stationary core 60 side such that the fitting groove 46 is axially recessed in the end surface 41 of the movable core 40 on a radially outer side of the receiving recess 45. The fitting groove 46 is configured into an annular form and radially outwardly extends from an end portion of an inner peripheral wall 451 of the receiving recess 45, which is opposite from a bottom wall 452 of the receiving recess 45. The flange 33 of the needle 30 is received in the receiving recess 45, and the movable plate 50, which will be described later in detail, is fitted into the fitting groove 46.

The movable plate 50 is made of a metal material, such as martensitic stainless steel, and is configured into a circular disk form that has an outer diameter larger than an inner diameter of the receiving recess 45, and a hole 51 axially extends through a center part of the movable plate 50. The movable plate 50 is placed on the stationary core 60 side of the movable core 40, which is axially opposite from the nozzle 10, such that the movable plate 50 is contactable with the movable core 40 and the flange 33 of the needle 30. In the present embodiment, the movable plate 50 is adapted to be received in the fitting groove 46.

The coil 70 is configured into a generally cylindrical tubular form and surrounds the outer peripheral wall of the housing 20, particularly the second tubular member 22 and the third tubular member 23. The molded resin portion 26 is filled between the first to third tubular members 21-23 and the outer peripheral member 25. An outer peripheral part of the molded resin portion 26 radially outwardly projects from the outer peripheral member 25 to form a connector (not shown), which receives a plurality of power supply terminals that are electrically connected with the coil 70. The coil 70 generates a magnetic force when an electric power is supplied to the coil 70 through the connector.

When the magnetic force is generated by the coil 70, a magnetic circuit is formed in the stationary core 60, the movable core 40, the first tubular member 21, the third tubular member 23 and the outer peripheral member 25. In this way, the movable core 40 is attracted to the stationary core 60. At this time, the bottom wall 452 of the receiving recess 45 contacts the flange 33 of the needle 30, so that the needle 30 is dragged by and is moved together with the movable core 40 toward the stationary core 60 side in the valve opening direction. In this way, the sealing portion 31 is lifted from the valve seat 12, and thereby the fuel injection hole 11 is opened to inject fuel therethrough. Then, the end surface 41 of the movable core 40 contacts the stationary core 60, so that the movement of the movable core 40 in the valve opening direction is limited.

One end portion of the first spring 80 contacts an end surface 52 of the movable plate 50, which is axially opposite from the needle 30. The other end portion of the first spring 80 contacts one end portion of an adjusting pipe 61, which is securely press fitted to, i.e., is fixed to an inner peripheral wall of the stationary core 60. The first spring 80 exerts an axial expansion force (axial resilient force, i.e., axial urging force). Thereby, the first spring 80 axially urges the movable plate 50 to axially urge the movable core 40 and the needle 30 in the valve closing direction.

One end portion of the second spring 90 contacts a bottom surface of a groove 431, which is configured into an annular form and is formed in an end surface 43 of the movable core 40 located on the side opposite from the stationary core 60. The other end portion of the second spring 90 contacts an annular step surface 211, which is formed in the inner wall of the first tubular member 21 of the housing 20. The second spring 90 exerts an axial expansion force (axial resilient force, i.e., axial urging force). Thereby, the second spring 90 axially urges the movable core 40 to axially urge the movable plate 50 together with the movable core 40 toward the stationary core 60 side.

In the present embodiment, the urging force of the first spring 80 is set to be larger than the urging force of the second spring 90. Thereby, in the deenergized state of the coil 70, i.e., the state (hereinafter referred to as a non-operating state) of the fuel injection valve 1, in which the fuel injection valve 1 is not operated, the sealing portion 31 of the needle 30 contacts the valve seat 12 and is thereby placed into a valve closing state, in which the sealing portion 31 closes the fuel injection hole 11 to stop the fuel injection through the fuel injection hole 11.

Figure 2:
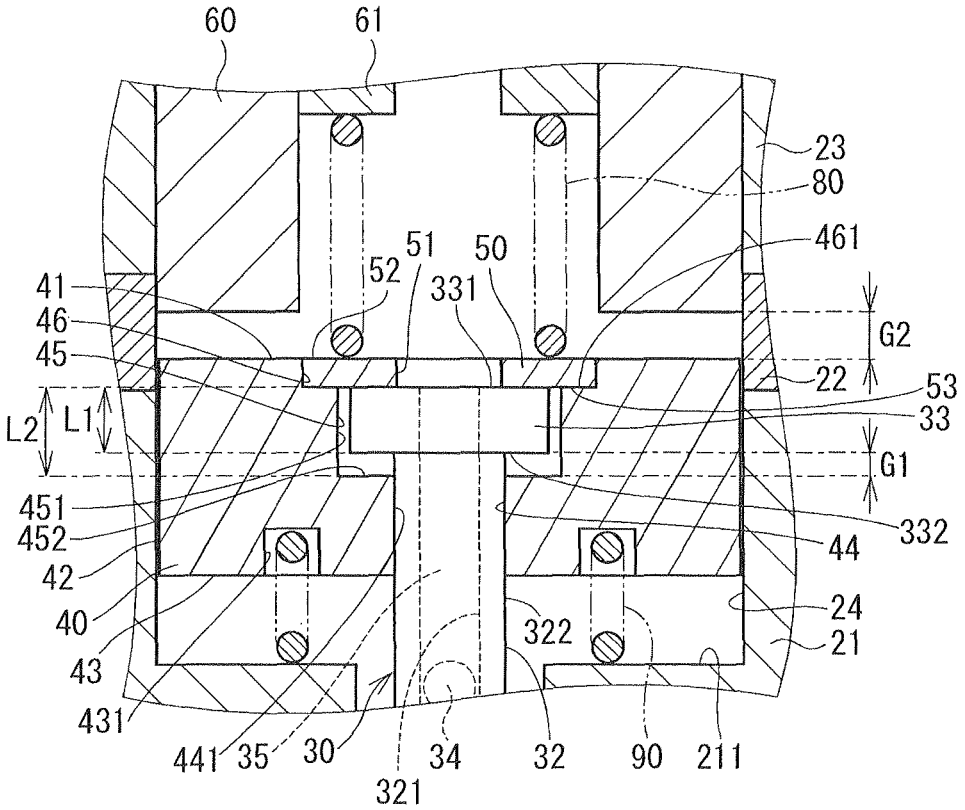
FIG. 2 is a schematic cross-sectional view showing a main feature of the fuel injection valve of the first embodiment.

As shown in FIG. 2, in the non-operating state of the fuel injection valve 1, due to the urging forces of the first and second springs 80, 90, a needle side end surface 53 of the movable plate 50, which is located on the needle 30 side, contacts an end surface 331 of the flange 33 of the needle 30 and a bottom wall 461 of the fitting groove 46 of the movable core 40. The flange 33, the movable plate 50, the receiving recess 45 and the fitting groove 46 are formed to satisfy a relationship of $L1<L2$ where $L1$ denotes an axial length of the flange 33, and $L2$ denotes an axial distance between the needle side end surface 53 of the movable plate 50 and the bottom wall 452 of the receiving recess 45. The needle side end surface 53 serves as a contactable surface of the movable plate 50, which is contactable with the needle 30.

Furthermore, in the state shown in FIG. 2, the flange 33, the movable plate 50, the receiving recess 45, the fitting groove 46, the movable core 40 and the stationary core 60 are formed to satisfy a relationship of $G1<G2$ and a relationship of $G1=L2-L1$ where $G1$ denotes an axial distance between an end surface 332 of the flange 33, which is opposite from the end surface 331, and the bottom wall 452 of the receiving recess 45, and $G2$ denotes an axial distance between the end surface 41 of the movable core 40 and the end surface of the stationary core 60 located on the movable core 40 side.

A fuel supply pipe 62, which is configured into a generally cylindrical tubular form, is press fitted into and is welded to an end portion of the third tubular member 23, which is opposite from the second tubular member 22.

The fuel, which is supplied into the housing 20 through a supply opening of the fuel supply pipe 62, flows through the inside of the stationary core 60, the inside of the adjusting pipe 61, the hole 51 of the movable plate 50, the inside of the main body 32 of the needle 30, the hole 34 of the needle 30, a gap between the first tubular member 21 and the needle 30 and a gap between the sealing portion 31 of the needle 30 and the valve seat 12 of the nozzle 10 and is finally guided into the fuel injection hole 11. That is, a fuel passage 100, which conducts the fuel, is formed in the inside of the housing 20.

Now, an assembling method of the fuel injection valve 1 of the present embodiment will be described.

Figure 3C:
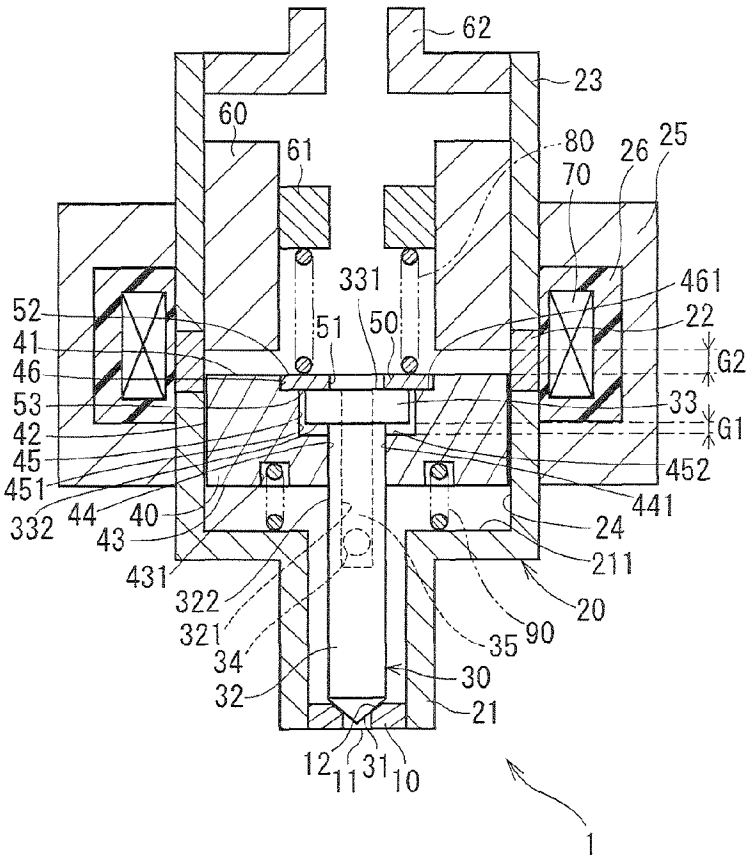
FIGS. 3A to 3C are schematic diagrams showing an assembling method of the fuel injection valve of the first embodiment.
Figure 3B:
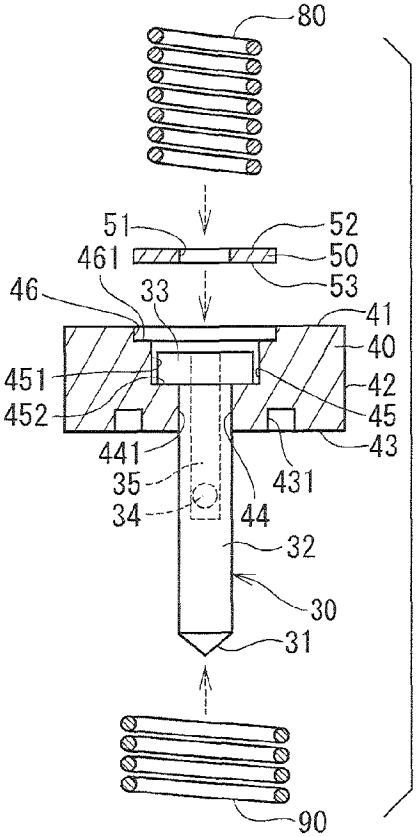
Figure 3A:
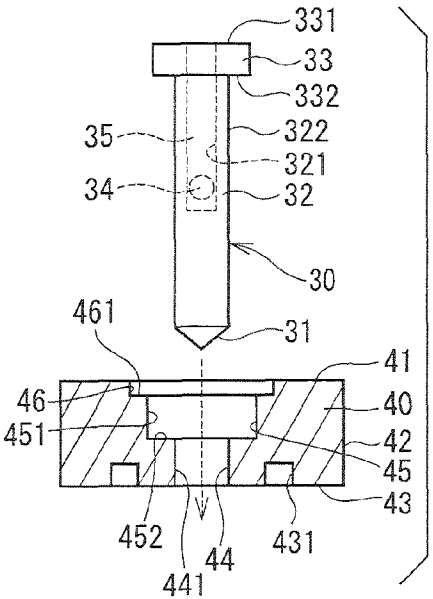

First of all, with reference to FIG. 3A, the needle 30 is inserted into the through-hole 44 of the movable core 40 such that the flange 33 of the needle 30 is received into the receiving recess 45.

Next, as shown in FIG. 3B, the movable plate 50 is fitted into the fitting groove 46 of the movable core 40, and the one end portion of the first spring 80 is engaged with the spring-side end surface 52 of the movable plate 50, which is axially opposite from the needle 30. Then, the second spring 90 is inserted over the needle 30 such that the one end portion of the second spring 90 is engaged with the bottom surface of the groove 431 of the movable core 40 from the axial side where the sealing portion 31 of the needle 30 is located, and thereby the needle 30 is placed in the inside of the second spring 90.

As shown in FIG. 3C, the assembly (sub-assembly) of the first spring 80, the movable plate 50, the needle 30, the movable core 40 and the second spring 90 is inserted into the housing 20, and the other end portion of the second spring 90 is engaged with the step surface 211 of the housing 20.

Finally, the stationary core 60 and the adjusting pipe 61 are press fitted into the housing 20, so that the other end portion of the first spring 80 is engaged with the adjusting pipe 61. The position of the stationary core 60 is adjusted to satisfy the relationship of G1<G2. Furthermore, the position of the adjusting pipe 61 is adjusted such that the urging force of the first spring 80 becomes larger than the urging force of the second spring 90.

Next, the operation of the fuel injection valve 1 of the present embodiment will be described with reference to FIGS. 4A to 6C.

Figure 4A:
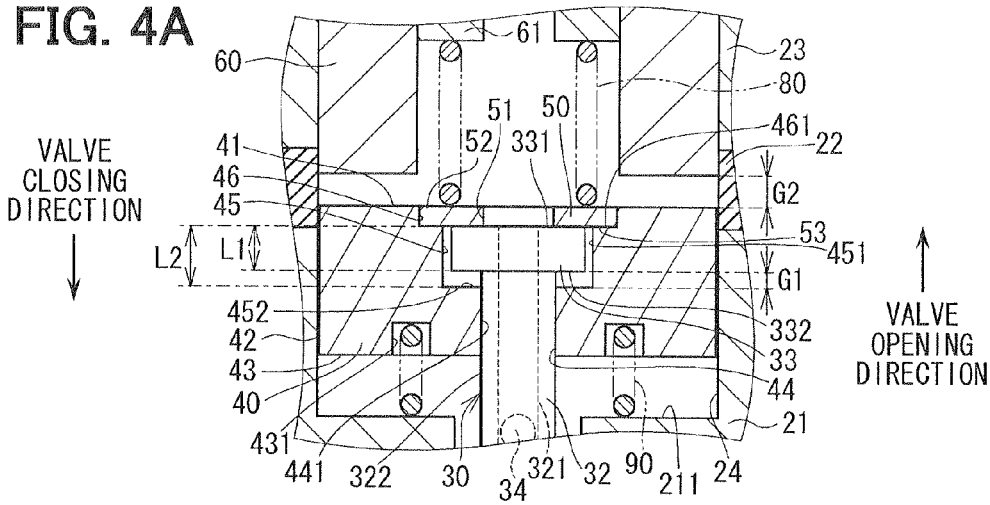
FIGS. 4A to 4C are schematic diagrams showing an operation of the fuel injection valve of the first embodiment.

As shown in FIG. 4A, in the non-operating state, the movable plate 50 is urged by the first spring 80, so that the needle 30 is urged in the valve closing direction by the first spring 80 through the movable plate 50. Furthermore, the movable core 40 is urged toward the stationary core 60 side by the second spring 90. The needle side end surface 53 of the movable plate 50, which is located on the needle 30 side, contacts the end surface 331 of the flange 33 of the needle 30 and the bottom wall 461 of the fitting groove 46 of the movable core 40. At this time, the axial distance L2 between the needle side end surface 53 of the movable plate 50 and the bottom wall 452 of the receiving recess 45 is larger than the axial length L1 of the flange 33. Furthermore, the predetermined axial distance G1 between the end surface 332 of the flange 33 and the bottom wall 452 of the receiving recess 45 is smaller than the axial distance G2 between the movable core 40 and the stationary core 60.

Furthermore, the sealing portion 31 of the needle 30 is seated against the valve seat 12, so that the fuel injection hole 11 of the nozzle 10 is placed in the closed state.

Figure 4B:
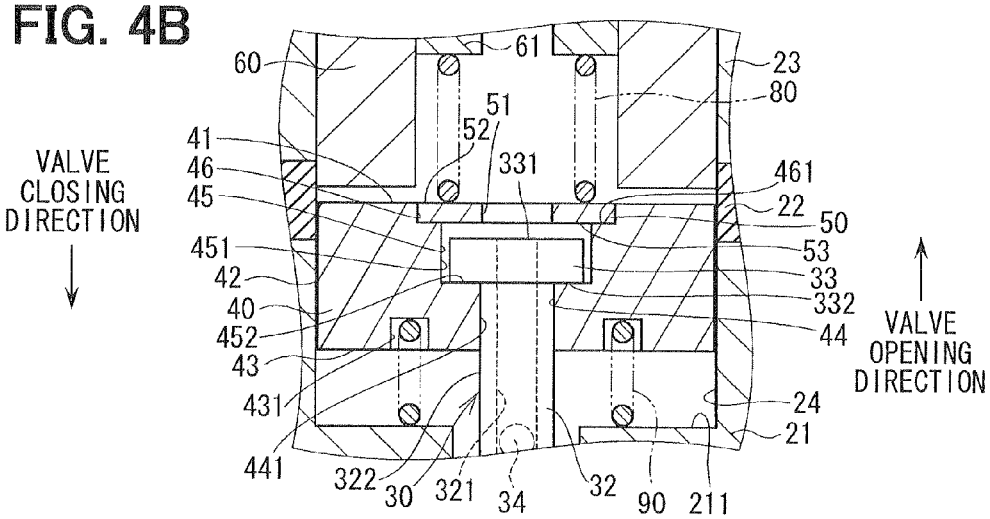

When the electric current is supplied to the coil 70, the movable core 40 is attracted toward the stationary core 60 side, as shown in FIG. 4B. At this time, the movable plate 50 is urged by the movable core 40 and is thereby moved toward the first spring 80 side against the urging force of the first spring 80. Furthermore, the movable core 40 is accelerated through the predetermined distance G1 and thereby collides against the end surface 332 of the flange 33 of the needle 30 while maintaining a motion energy that corresponds to the acceleration of the movable core 40 made through the predetermined distance G1.

At this time, the needle 30 is rapidly moved in the valve opening direction, and the sealing portion 31 of the needle 30 is lifted away from the valve seat 12. Thereby, the fuel injection hole 11 of the nozzle 10 is rapidly opened. The fuel, which is supplied through the fuel supply pipe 62, flows through the fuel passage 100 and is injected through the fuel injection hole 11.

Figure 4C:
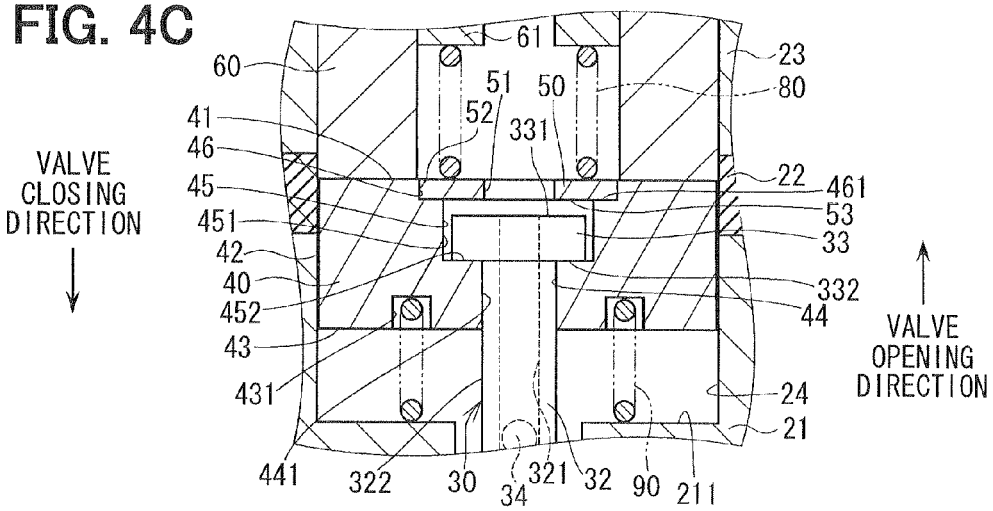

As shown in FIG. 4C, when the movable core 40 collides against the stationary core 60, the movement of the movable core 40 is limited.

At this time, the amount of lifting of the needle 30 is maximized, so that the fuel injection hole 11 of the nozzle 10 is placed into a maximum open state.

Figure 5A:
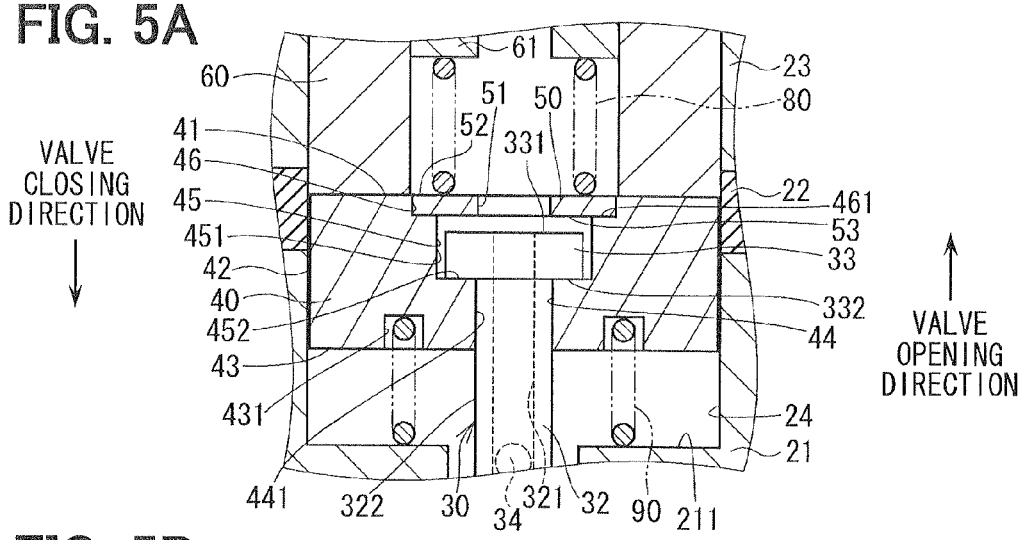
FIGS. 5A to 5C are schematic diagrams showing the operation of the fuel injection valve of the first embodiment.

When the supply of the electric current to the coil 70 is stopped, the attracting force, which is generated by the coil 70, becomes small. Immediately after the stopping of the supply of the electric current to the coil 70, the movable core 40 and the stationary core 60 maintains the contact state therebetween for a short period of time, as shown in FIG. 5A.

Figure 5B:
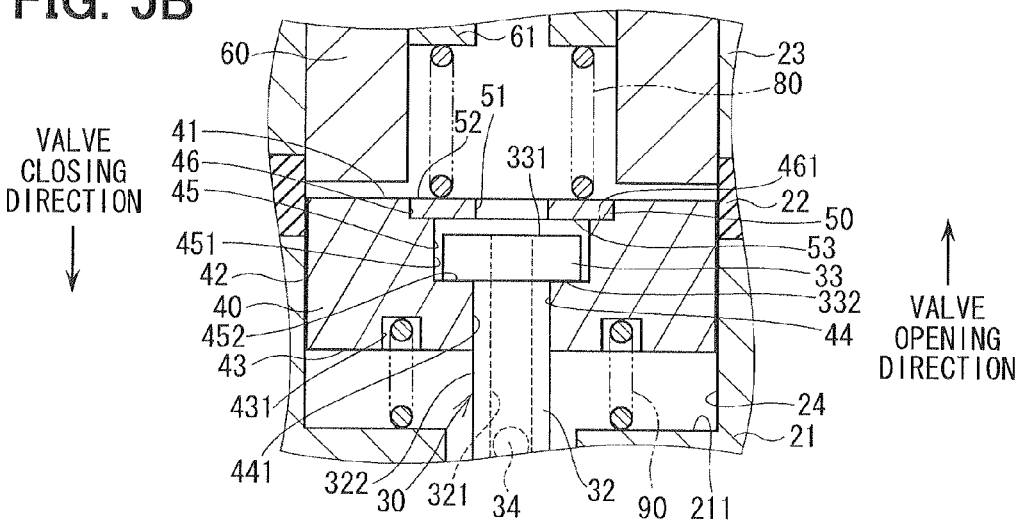

Then, when the attracting force, which is generated by the coil 70, becomes lower than the holding force for holding the valve open state, the movable plate 50, the movable core 40 and the needle 30 are moved in the valve closing direction, as shown in FIG. 5B.

Figure 5C:
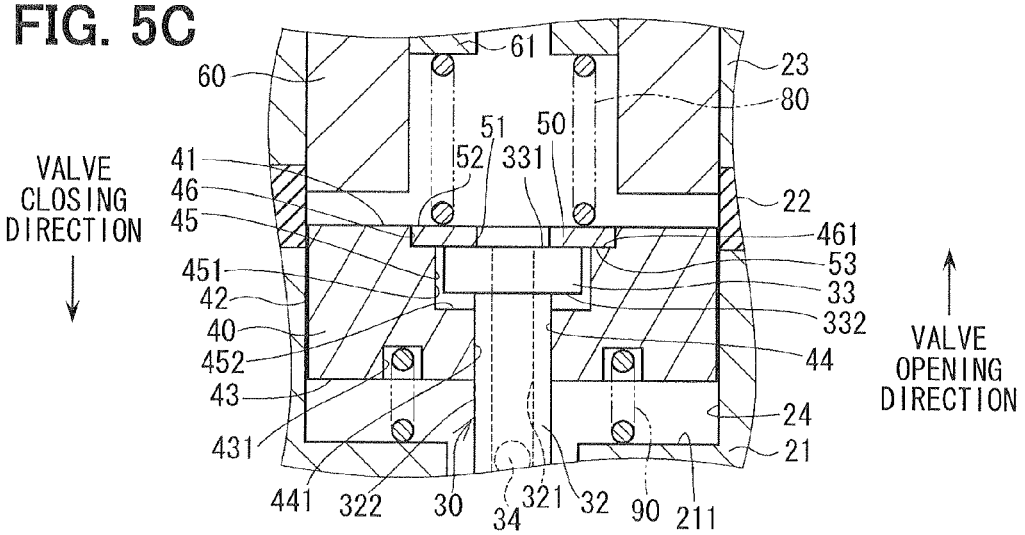

When the sealing portion 31 of the needle 30 contacts the valve seat 12 of the nozzle 10, the movement of the needle 30 is stopped. As shown in FIG. 5C, when the movable plate 50 contacts the end surface 331 of the needle 30, the movement of the movable plate 50 is stopped, and the movable plate 50 is urged against the needle 30 by the first spring 80.

Figure 6A:
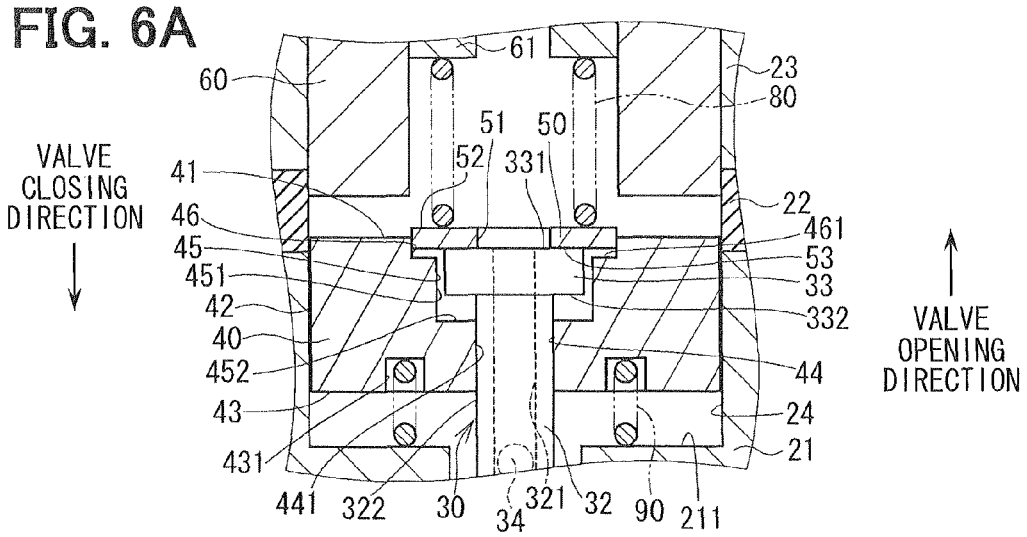
FIGS. 6A to 6C are schematic diagrams showing the operation of the fuel injection valve of the first embodiment.

Thereafter, as shown in FIG. 6A, the movable core 40 urges the second spring 90 toward the nozzle 10 side with the inertial force of the movable core 40.

Figure 6B:
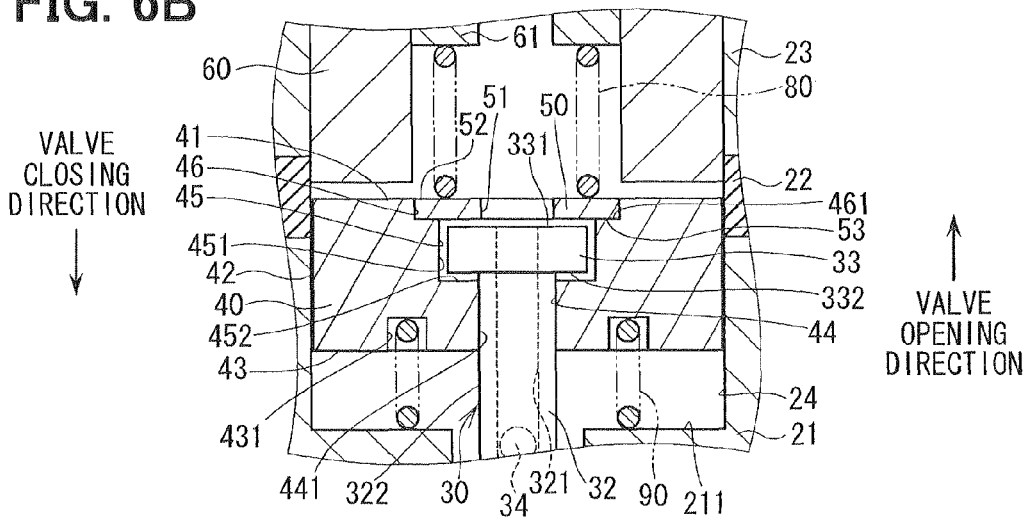

The second spring 90, which is urged by the movable core 40, is contracted to its limit and is then sprung back to drive the movable core 40 toward the movable plate 50 side. At this time, as shown in FIG. 6B, the bottom wall 452 of the receiving recess 45 of the movable core 40 does not contact the end surface 332 of the flange 33 of the needle 30, and the bottom wall 461 of the fitting groove 46 contacts the needle side end surface 53 of the movable plate 50. Then, the movable core 40 is moved toward the step surface 211 side once again by the urging force of the first spring 80.

Figure 6C:
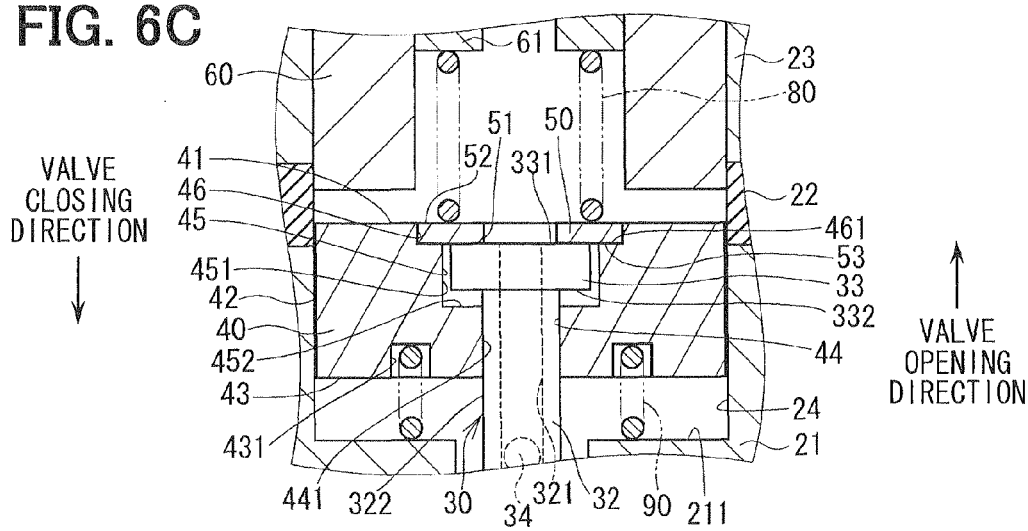

The movable core 40 axially oscillates until the time of depleting the motion energy of the movable core 40 and is finally placed in the non-moving state (stationary state), as shown in FIG. 6C.

As discussed above, according to the present embodiment, the flange 33, the movable plate 50, the receiving recess 45 and the fitting groove 46 are formed to satisfy the relationship of L1<L2 in the contact state of the movable core 40 and the movable plate 50, in which the movable core 40 and the movable plate 50 contact with each other in the axial direction. In this way, the gap, which has the predetermined axial distance G1, is formed between the end surface 332 of the flange 33 and the bottom wall 452 of the receiving recess 45. Therefore, when the movable core 40 is attracted in the valve opening direction by the magnetic force of the coil 70 upon supplying of the electric power to the coil 70, the movable core 40 is accelerated through the predetermined axial distance G1 and collides against the flange 33 of the needle 30. Therefore, the needle 30 can be lifted quickly by using the collision energy of the movable core 40.

Furthermore, according to the present embodiment, the predetermined gap G1 is formed between the end surface 332 of the flange 33 and the bottom wall 452 of the receiving recess 45. Therefore, it is possible to limit the abutment of the movable core 40, which is driven back by the second spring 90 after urging the second spring 90, against the flange 33 of the needle 30, which is held in the valve closed state. Therefore, it is possible to limit occurrence of the secondary valve opening, which would be otherwise caused by the movable core 40 that is urged back by the second spring 90.

Furthermore, the predetermined distance G1 is determined by the axial length L1 of the flange 33 and the axial distance L2 between the movable plate 50 and the bottom wall 452 of the receiving recess 45. Therefore, the predetermined distance G1 can be adjusted by changing the axial length L1 of the flange 33 and/or the axial distance L2 between the movable plate 50 and the bottom wall 452 of the receiving recess 45. Thus, the clearance can be easily controlled.

According to the present embodiment, the movable core 40 has the fitting groove 46, which is formed in the end surface 41 of the movable core 40 located on the stationary core 60 side and which is adapted to receive the movable plate 50 therein. Thus, at the time of contacting the movable plate 50 and the movable core 40 together, it is possible to limit lifting of the movable plate 50 by the end surface 41 of the movable core 40.

Second Embodiment

Figure 7:
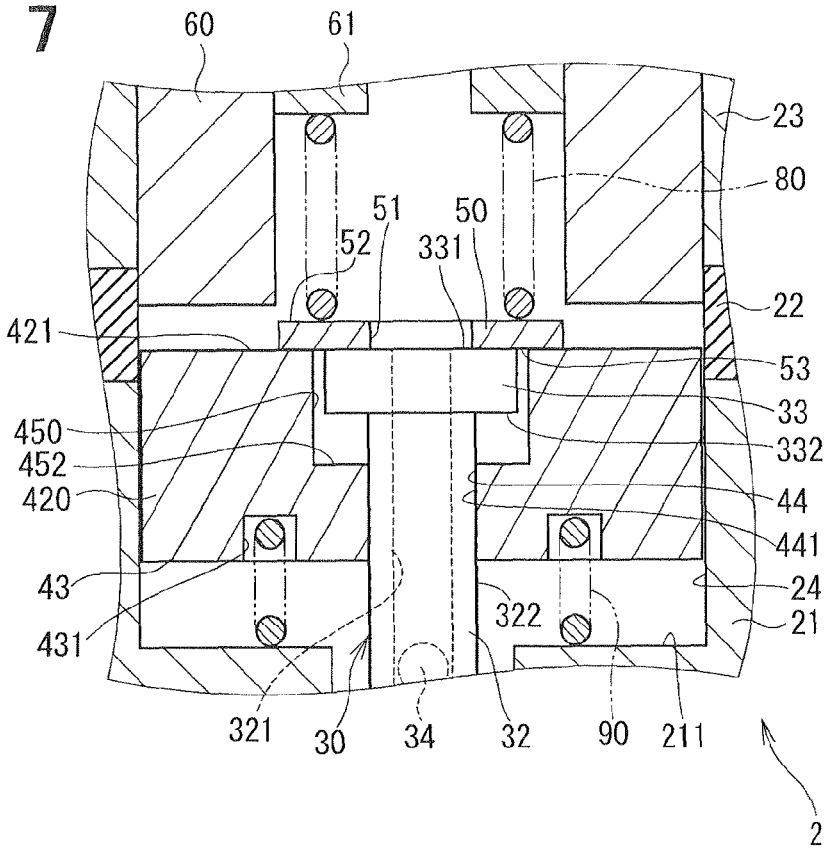
FIG. 7 is a schematic cross-sectional view showing a main feature of a fuel injection valve according to a second embodiment of the present invention.

FIG. 7 shows a fuel injection valve 2 according to a second embodiment of the present invention. In the following discussion, components, which are similar to those discussed in the above embodiment, will be indicated by the same reference numerals and will not be described redundantly for the sake of simplicity. As shown in FIG. 7, a movable core 420 of the fuel injection valve 2 has only a receiving recess 450 on the stationary core 60 side of the movable core 420, and an inner diameter of the receiving recess 450 is larger than that of the through-hole 44. The movable plate 50 is contactable with the flange 33 of the needle 30 and the end surface 421 of the movable core 420 located on the stationary core 60 side.

With the above-described construction, the needle 30 can be quickly lifted to open the fuel injection hole 11 like in the above embodiment. Furthermore, it is possible to limit occurrence of the secondary valve opening, which would be otherwise caused by the movable core 40 that is urged back by the second spring 90.

Third Embodiment

Figure 8:
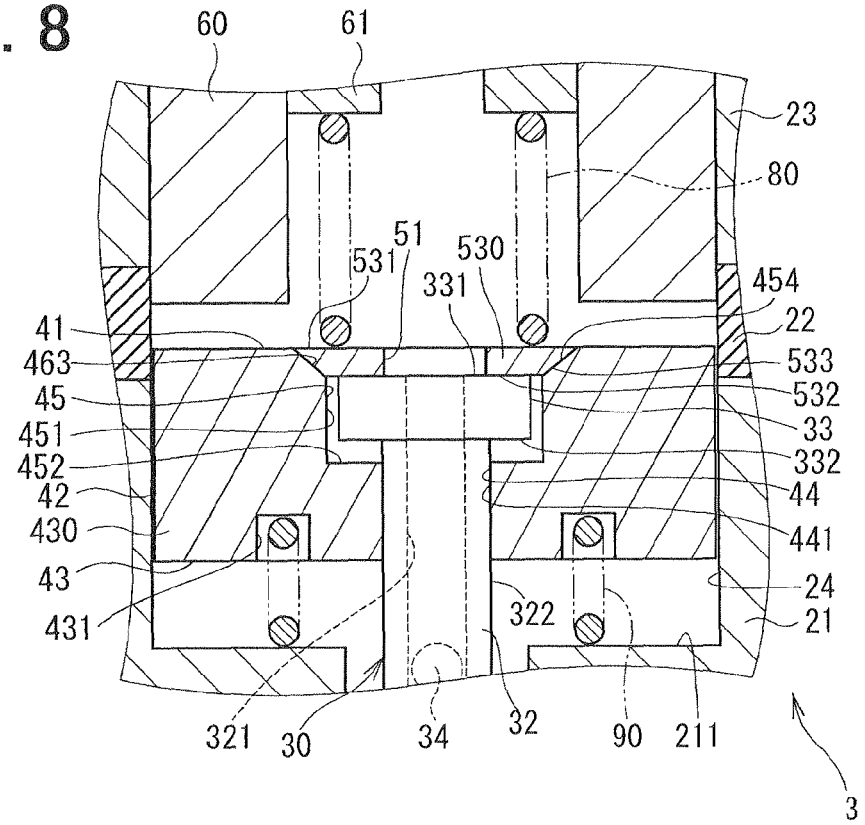
FIG. 8 is a schematic cross-sectional view showing a main feature of a fuel injection valve according to a third embodiment of the present invention.

FIG. 8 shows a fuel injection valve 3 according to a third embodiment of the present invention. In the following discussion, components, which are similar to those discussed in the above embodiment(s), will be indicated by the same reference numerals and will not be described redundantly for the sake of simplicity.

As shown in FIG. 8, an outer peripheral edge portion 533 of the movable plate 530 of the fuel injection valve 3 is tapered such that an outer diameter of the movable plate 530 progressively increases in the axial direction from the needle 30 side toward the first spring 80 side. That is, the outer peripheral edge portion 533 of the movable plate 530 is tapered such that the outer diameter of the spring-side end surface 531 of the movable plate 530, which is located on the first spring 80 side, is larger than the outer diameter of the needle side end surface 532 of the movable plate 530, which is located on the needle 30 side. The needle side end surface 532 serves as a contactable surface of the movable plate 530, which is contactable with the needle 30.

An inner peripheral edge portion (also referred to as an opening-side inner peripheral edge portion) 454, which is formed at an opening of the receiving recess 45 in the end surface 41 of the movable core 430 located on the stationary core 60 side, is tapered such that an inner diameter of the inner peripheral edge portion 454 of the receiving recess 45 progressively increases in the axial direction from the bottom wall 452 side of the receiving recess 45 toward the stationary core 60 side. In the present embodiment, at the time of contacting the movable plate 530 and the movable core 430 together, the outer peripheral edge portion 533 of the movable plate 530 is axially opposed to and is engaged with the inner peripheral edge portion 454 of the receiving recess 45.

In the present embodiment, since the outer peripheral edge portion 533 of the movable plate 530 is tapered, it is possible to limit a positional deviation between the movable plate 530 and the movable core 40. Furthermore, since the inner peripheral edge portion 454 of the receiving recess 45 of the movable core 430 is tapered, it is possible to further limit the positional deviation between the movable plate 530 and the movable core 40. The inner peripheral edge portion 454 of the receiving recess 45 may serves as a fitting groove, which is adapted to receive the outer peripheral edge portion 533 of the movable plate 530.

Fourth Embodiment

Figure 9:
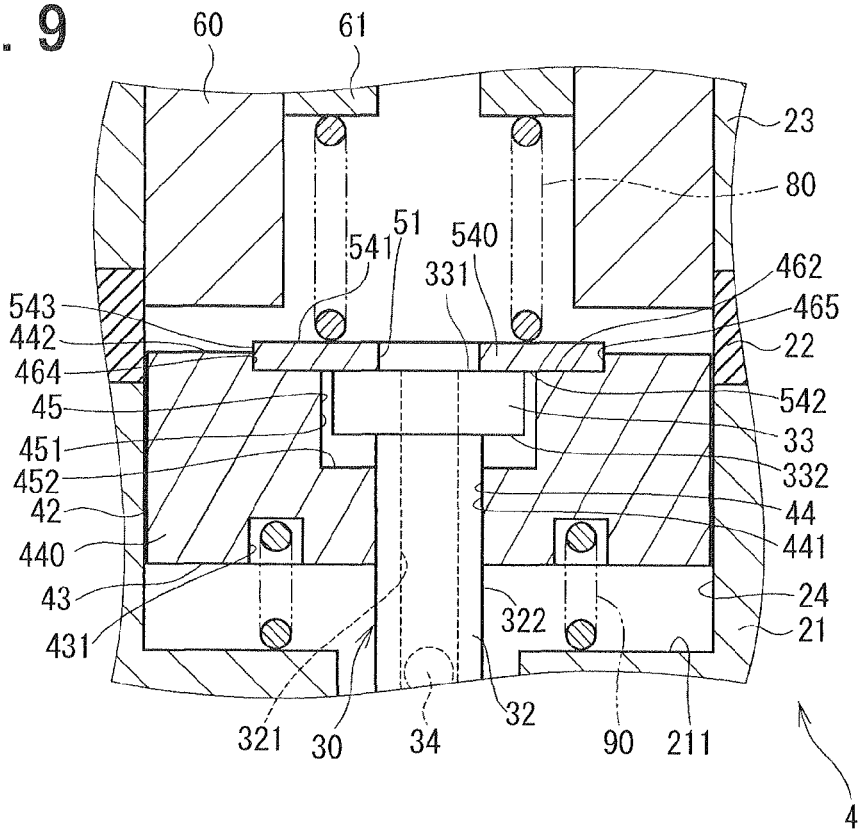
FIG. 9 is a schematic cross-sectional view showing a main feature of a fuel injection valve according to a fourth embodiment of the present invention.

FIG. 9 shows a fuel injection valve 4 according to a fourth embodiment of the present invention. In the following discussion, components, which are similar to those discussed in the above embodiment(s), will be indicated by the same reference numerals and will not be described redundantly for the sake of simplicity.

As shown in FIG. 9, an outer diameter of a movable plate 540 of the fuel injection valve 4 is larger than an inner diameter of the stationary core 60. Furthermore, an axial height (axial extent) of an outer peripheral edge portion 543 of the movable plate 540 is larger than an axial height (axial extent) of an inner peripheral wall 465 of a fitting groove 464. Therefore, in a contact state where a needle side end surface 542 of the movable plate 540 and a bottom wall 462 of the fitting groove 464 contact with each other, a spring side end surface 541 of the movable plate 540, which is located on the stationary core 60 side, is axially placed on a stationary core 60 side of an end surface 442 of the movable core 440, which is located on the stationary core 60 side. The needle side end surface 542 serves as a contactable surface of the movable plate 540, which is contactable with the needle 30.

In the present embodiment, the outer diameter of the movable plate 540 is made larger than the inner diameter of the stationary core 60, and the axial height (axial extent) of the outer peripheral edge portion 543 of the movable plate 540 is made larger than the axial height (axial extent) of the inner peripheral wall 465 of the fitting groove 464. In this way, the stationary core 60 does not contact the movable core 440 and only contacts the movable plate 540. Therefore, a hardening process may be performed only on the surface of the movable plate 540 to harden the surface of the movable plate 540 instead of handing the surface of the movable core 440, so that the surface of the movable plate 540 is made of the hard material, which is harder than that of the movable core 440. As a result, in comparison to the above embodiments, the movable core 440 can be formed into the simple form, and thereby it is possible to reduce or minimize the costs.

Fifth Embodiment

Figure 10:
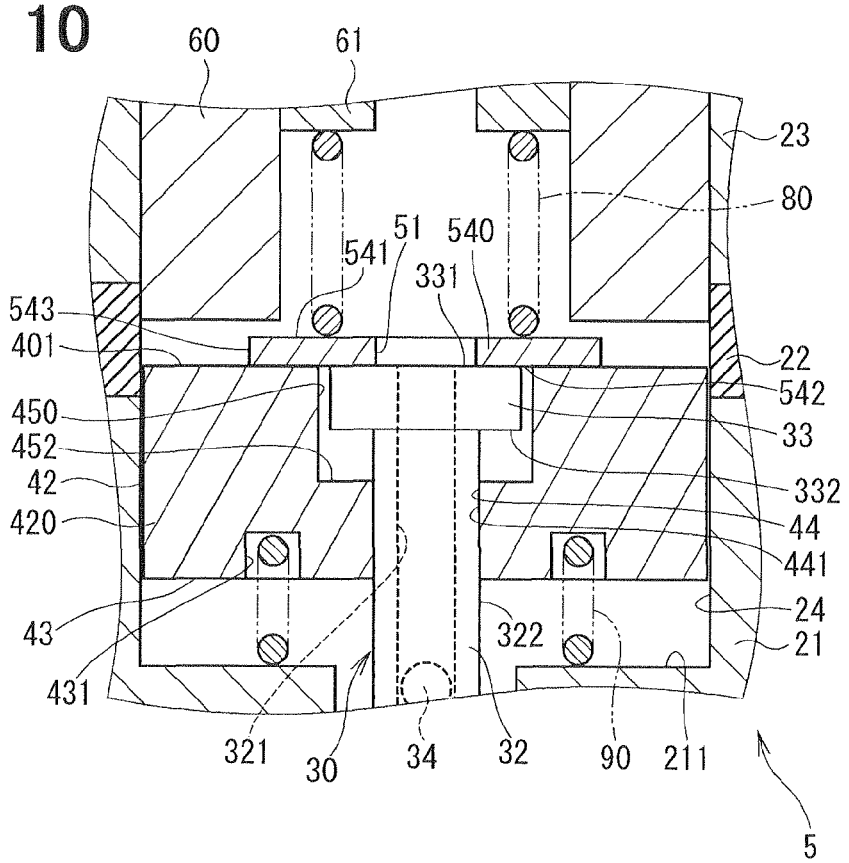
FIG. 10 is a schematic cross-sectional view showing a main feature of a fuel injection valve according to a fifth embodiment of the present invention.

FIG. 10 shows a fuel injection valve 5 according to a fifth embodiment of the present invention. In the following discussion, components, which are similar to those discussed in the above embodiment(s), will be indicated by the same reference numerals and will not be described redundantly for the sake of simplicity. As shown in FIG. 10, the movable core 420 of the fuel injection valve 5 has only the receiving recess 450 in the stationary core 60 side end surface 401 of the movable core 420, and the inner diameter of the receiving recess 450 is larger than that of the through-hole 44. Furthermore, the outer diameter of the movable plate 540 is larger than the inner diameter of the stationary core 60. In this embodiment, similar to the fourth embodiment, a hardening process may be performed only on the surface of the movable plate 540 to harden the surface of the movable plate 540 instead of handing the surface of the movable core 420, so that the surface of the movable plate 540 is made of the hard material, which is harder than that of the movable core 420.

With the above construction of the present embodiment, the movable core 420 can be formed into the simpler form in comparison to the fourth embodiment, and thereby the costs can be further reduced or minimized.

Sixth Embodiment

Figure 11:
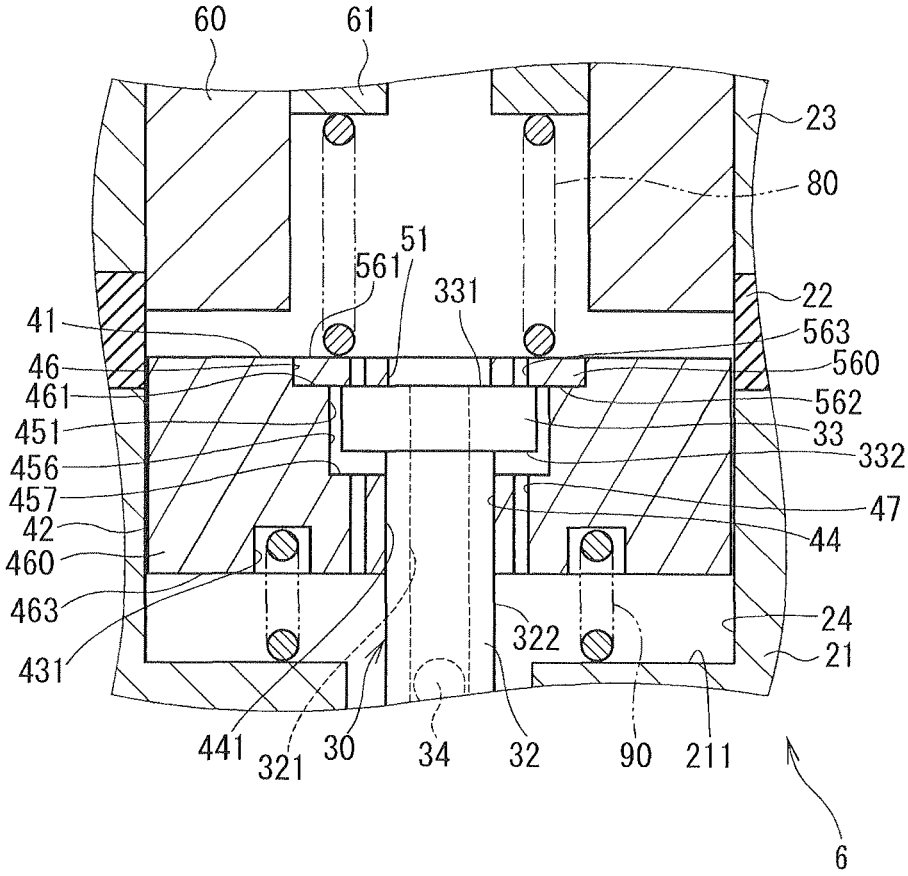
FIG. 11 is a schematic cross-sectional view showing a main feature of a fuel injection valve according to a sixth embodiment of the present invention.

FIG. 11 shows a fuel injection valve 6 according to a sixth embodiment of the present invention. In the following discussion, components, which are similar to those discussed in the above embodiment(s), will be indicated by the same reference numerals and will not be described redundantly for the sake of simplicity.

As shown in FIG. 11, a movable core 460 of the fuel injection valve 6 includes a plurality of primary holes 47. The primary holes 47 are arranged symmetrically about the central axis of the movable core 460. The primary holes 47 axially connect between a bottom wall 457 of a receiving recess 456 and an end surface 463 of the movable core 460 located on the nozzle 10 side.

Furthermore, a movable plate 560 has a plurality of secondary holes 563, which axially extend through the movable plate 560 in a plate thickness direction of the movable plate 560 and are located at a contact area of the movable plate 560 that is adapted to contact the flange 33 of the needle 30. The secondary holes 563 connect between a spring-side end surface 561 of the movable plate 560, which is located on the stationary core 60 side, and a needle side end surface 562 of the movable plate 560, which is located on the needle 30 side. The needle side end surface 562 serves as a contactable surface of the movable plate 50, which is contactable with the needle 30.

In the present embodiment, the primary holes 47 are formed in the movable core 460, so that it is possible to limit adhesion (wringing) between the flange 33 of the needle 30 and the bottom wall 457 of the receiving recess 456 caused by a wringing force exerted therebetween after the contacting of the flange 33 of the needle 30 to the bottom wall 457 of the receiving recess 456. Furthermore, the secondary holes 563 are formed in the movable plate 560, so that it is possible to limit adhesion (wringing) between the movable plate 560 and the flange 33 of the needle 30 caused by a wringing force exerted therebetween after the contacting of the flange 33 of the needle 30 to the movable plate 560.

Seventh Embodiment

Figure 12:
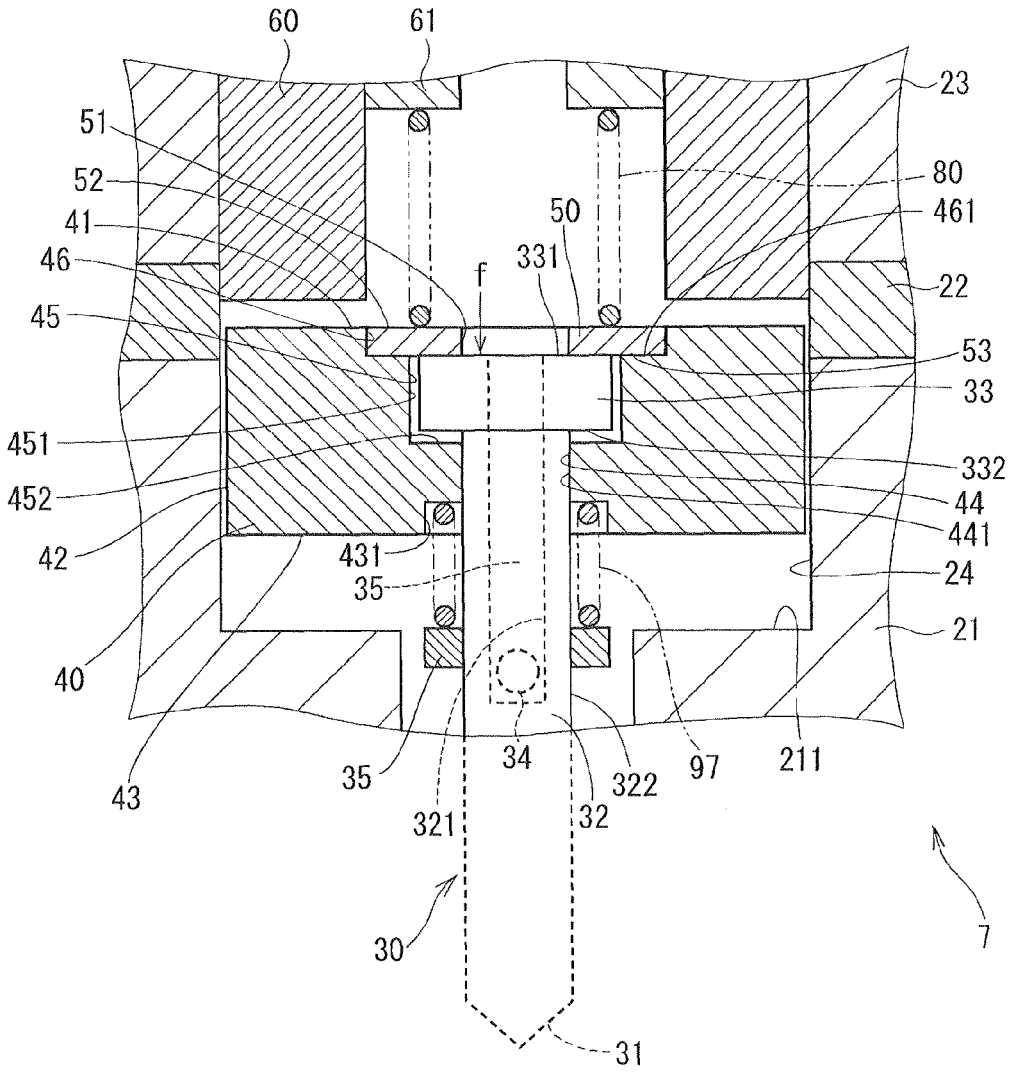
FIG. 12 is a schematic cross-sectional view showing a main feature of a fuel injection valve according to a seventh embodiment of the present invention.

FIG. 12 shows a fuel injection valve 7 according to a seventh embodiment of the present invention. In the following description, components, which are similar to those of the first embodiment, will be indicated by the same reference numerals and will not be described further.

FIG. 12 is a schematic cross-sectional view showing a valve closed state of fuel injection valve 7. As shown in FIG. 12, an engaging portion 35 is provided to the needle 30. The engaging portion 35 radially outwardly projects from the outer peripheral wall 322 of the main body 32 at an axial location between the flange 33 and the seating portion 31. Thereby, a second spring 97 is provided between the movable core 40 and the engaging portion 35 in the axial direction and axially urges the needle 30 in the valve closing direction through the engaging portion 35.

Now, the operation of the fuel injection valve 7 at the time of valve opening will be described with reference to FIGS. 13A to 13C.

Figure 13A:
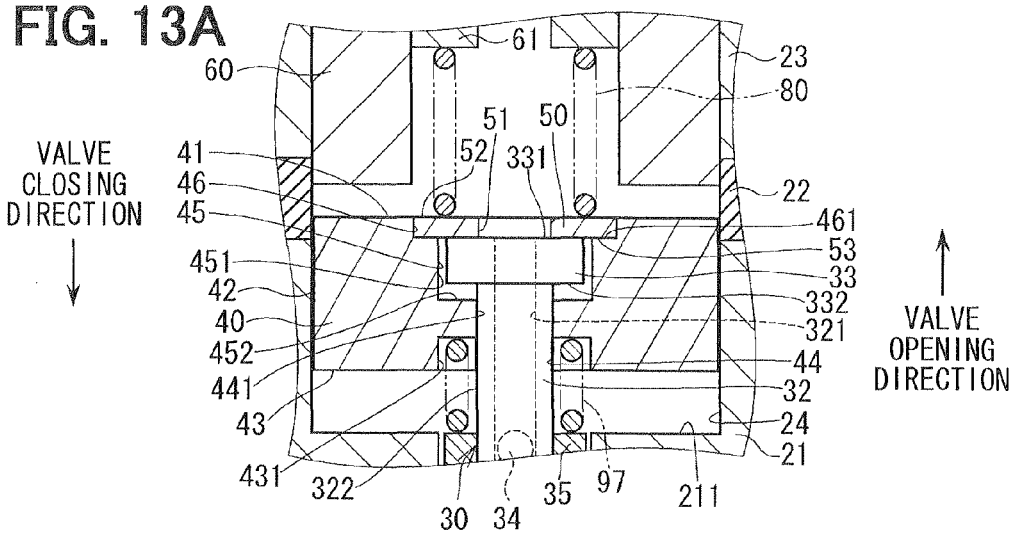
FIGS. 13A to 13C are schematic diagrams showing an operation of the fuel injection valve of the seventh embodiment.

As shown in FIG. 13A, in the non-operating state, the movable plate 50 is axially urged by a first spring 80, so that the needle 30 is axially urged by the first spring 80 through the movable plate 50 in the valve closing direction. Furthermore, one end portion of the second spring 97 is engaged with the engaging portion 35, and the other end portion of the second spring 97 is engaged with the movable core 40. Thereby, the second spring 97 urges the needle 30 through the engaging portion 35 in the valve closing direction, and the movable core 40 is urged toward the stationary core 60 side by the second spring 97.

At this time, the sealing portion 31 of the needle 30 is seated against the valve seat 12, so that the fuel injection hole 11 of the nozzle 10 is placed in the closed state.

Figure 13B:
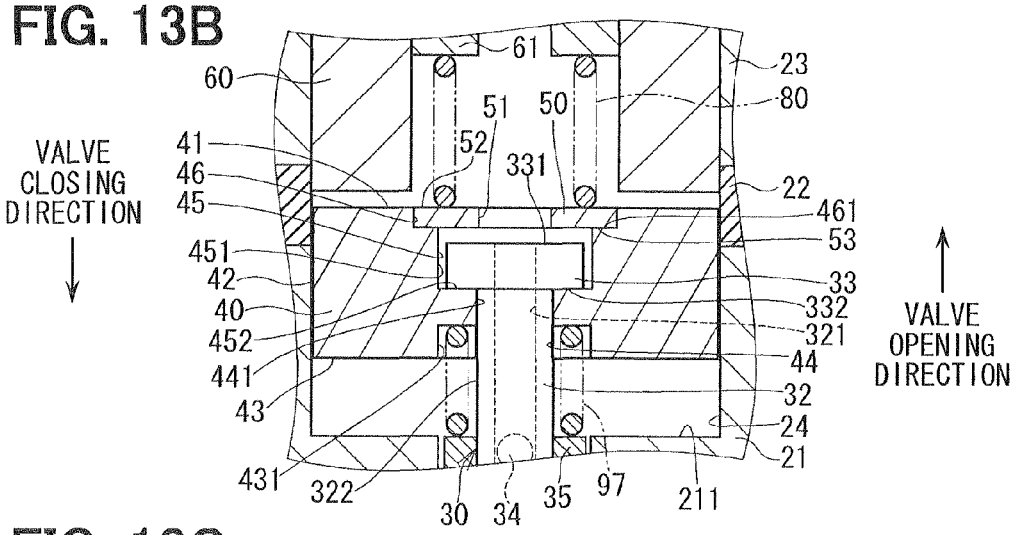

When the electric current is supplied to the coil 70, the movable core 40 is attracted toward the stationary core 60 side, as shown in FIG. 13B. At this time, the movable plate 50 is urged by the movable core 40 and is thereby moved toward the first spring 80 side against the urging force of the first spring 80. Furthermore, the movable core 40 collides against the end surface 332 of the flange 33 of the needle 30 while maintaining the motion energy that corresponds to the acceleration of the movable core 40 made through the predetermined distance (i.e., the axial distance between the end surface 332 of the flange 33 and the bottom wall 452 of the receiving recess 45 shown in FIG. 13A).

At this time, the needle 30 is rapidly moved in the valve opening direction, and the sealing portion 31 of the needle 30 is lifted away from the valve seat 12. Thereby, the fuel injection hole 11 of the nozzle 10 is rapidly opened. The fuel, which is supplied through the fuel supply pipe 62, flows through the fuel passage 100 and is injected through the fuel injection hole 11.

Figure 13C:
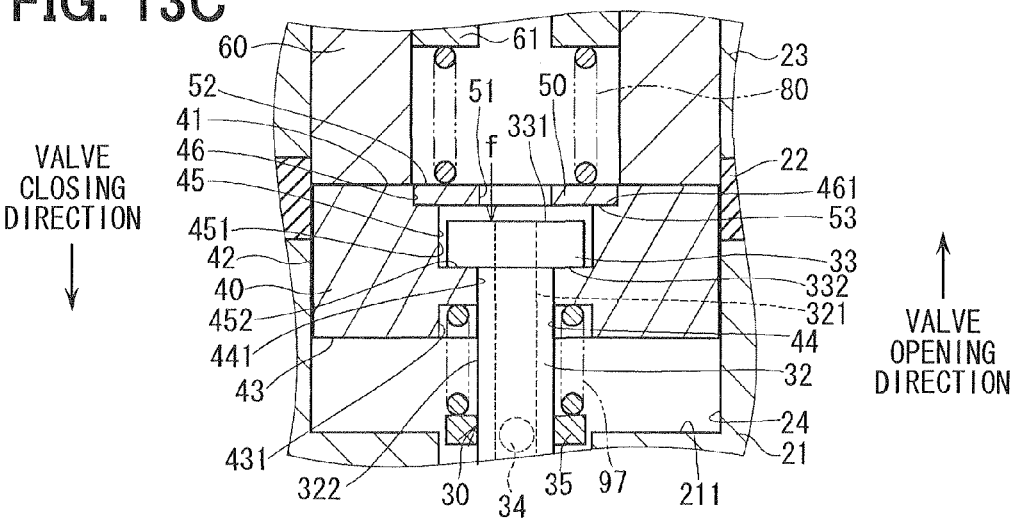

As shown in FIG. 13C, when the movable core 40 collides against the stationary core 60, the axial movement of the movable core 40 is limited.

At this time, the amount of lifting of the needle 30 is maximized, so that the fuel injection hole 11 of the nozzle 10 is placed into a maximum open state. Furthermore, the needle 30 is urged in the valve closing direction by a pressure f of the fuel and is also urged in the valve closing direction by the urging force of the second spring 97.

In the present embodiment, the engaging portion 35 is provided to the needle 30, and the second spring 97 urges the needle 30 through the engaging portion 35. In this way, at the time of holding the valve open state shown in FIG. 13C, the needle 30 is urged in the valve closing direction by the pressure f of the fuel and is also urged in the valve closing direction by the urging force of the second spring 97. Thus, the axial oscillation of the needle 30 is limited, and thereby the seating stability of the needle 30 is improved.

Eighth Embodiment

Figure 14:
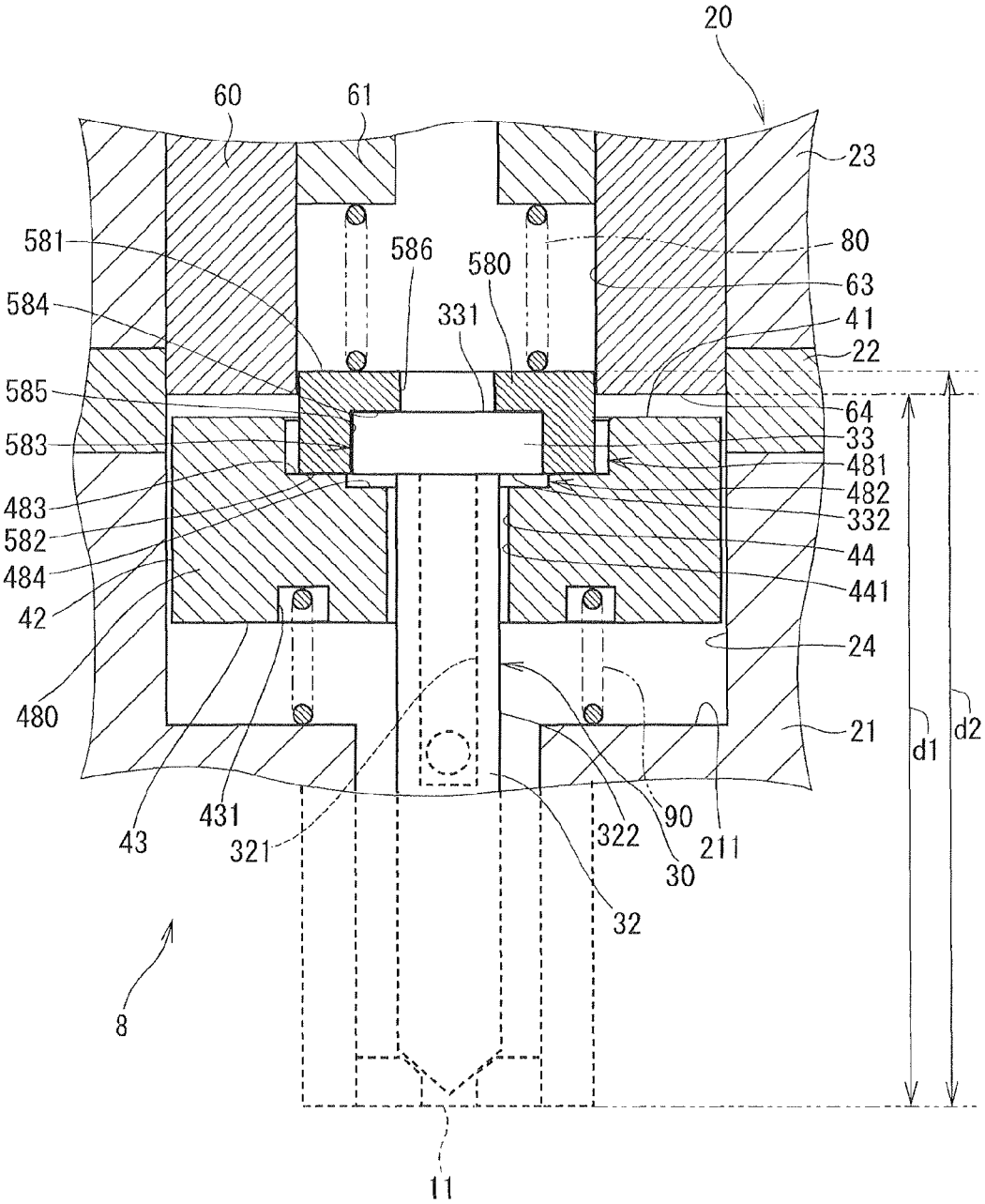
FIG. 14 is a schematic cross-sectional view showing a main feature of a fuel injection valve according to an eighth embodiment of the present invention.

FIG. 14 shows a fuel injection valve 8 according to an eighth embodiment of the present invention. In the following description, components, which are similar to those of the first embodiment, will be indicated by the same reference numerals and will not be described further.

As shown in FIG. 14, the stationary core 60 of the fuel injection valve 8 is configured into the tubular form and has an inner peripheral wall 63 and a nozzle side end portion 64.

A movable core 480 includes a first recess 481 and a second recess 482, which are formed in the stationary core 60 side part of the movable core 480. The first recess 481 is axially recessed from the end surface 41 of the movable core 480 and has a first bottom 483. The second recess 482 is axially recessed from the first bottom 483 of the first recess 481 on a radially inner side of the first recess 481 and has a second bottom (serving as a bottom wall) 484. The through-hole 44 is formed in the second bottom 484. The second bottom 484 serves as a bottom wall of the receiving recess, to which the flange 33 of the needle 30 is contactable.

A movable plate 580 includes a spring-side end surface 581, a nozzle side end surface 582 and a receiving portion 583. The receiving portion 583 is axially recessed from the nozzle side end surface 582 and has a bottom 584 and an inner peripheral wall 585. A hole 586 is formed in the bottom 584 to axially extend therethrough. A surface of the bottom 584 serves as a contactable surface of the movable plate 580, which is contactable with the needle 30. The spring-side end surface 581 serves as a first urging member side end surface of the movable plate 580.

In the present embodiment, the movable plate 580 is guided along the inner peripheral wall 63 of the stationary core 60 and is adapted to reciprocate in the axial direction. Here, an axial distance d2 between the spring-side end surface 581 of the movable plate 580 and the fuel injection hole 11 (more specifically, a downstream end of the fuel injection hole 11 in this instance) and an axial distance d1 between the nozzle side end portion 64 of the stationary core 60 and the fuel injection hole 11 (more specifically, the downstream end of the fuel injection hole 11 in this instance) satisfy a relationship of d1<d2.

The movable plate 580 is formed such that the nozzle side end surface 582 of the movable plate 580 and the first bottom 483 of the first recess 481 of the movable core 480 are contactable with each other. With this construction, the flange 33 side end portion of the needle 30, which is received in the through-hole 44 of the movable core 480, is received in the receiving portion 583 and is guided by the inner peripheral wall 585 of the receiving portion 583 such that the flange 33 side end portion of the needle 30 is axially movable. At the time of valve closing, the end surface 331 of the flange 33 contacts the bottom 584 of the receiving portion 583. At the time of valve opening, the end surface 332 of the flange 33 and the second bottom 484 of the second recess 482 contact with each other.

In the eighth embodiment, the movable plate 580 is guided by the inner peripheral wall 63 of the stationary core 60 and is adapted to reciprocate in the axial direction. Furthermore, the flange 33 of the needle 30 is guided by the inner peripheral wall 585 of the receiving portion 583 such that the flange 33 of the needle 30 is adapted to reciprocate in the axial direction. With this construction, the needle 30 is guided by the inner peripheral wall 63 of the stationary core 60 through the movable plate 580. This construction is advantageous for improving the coaxiality of the stationary core 60, the movable plate 580 and the needle 300 in comparison to the case where the needle 30 is guided by the inner peripheral wall 24 of the housing 20 through the movable core 480. Thus, it is possible to limit the tilting of the needle 30 in the radial direction during the reciprocation of the needle 30 in the axial direction. As a result, it is possible to improve the stability of the axial reciprocation of the needle 30.

Furthermore, the movable plate 580 is constructed such that the axial distance d2 between the spring-side end surface 581 of the movable plate 580 and the fuel injection hole 11 is longer that the axial distance d1 between the nozzle side end portion 64 of the stationary core 60 and the fuel injection hole 11. In this way, for example, at the time of valve closing, it is possible to limit the detachment of the movable plate 580 from the inner peripheral wall 63 of the stationary core 60. As a result, it is possible to further improve the stability of the axial reciprocation of the needle 30.

The above embodiments may be modified as follows.

In the above embodiments, the receiving recess is formed in the movable core. Alternatively, the receiving recess may be formed in the needle side part of the movable plate. In such a case, the flange of the needle and the receiving recess of the movable plate may be constructed such that the axial length of the flange of the needle is shorter than the axial distance between the end surface of the movable core located on the stationary core side and the bottom wall of the receiving recess.

In the above embodiment, the axial through-holes are formed in the movable core and the movable plate. Alternatively, an axial through-hole(s) may be formed in the flange of the needle.

In the above embodiments, the housing and the nozzle are formed separately. Alternatively, the housing and the nozzle may be formed integrally as one-piece body.

In the above embodiment, the inner peripheral edge portion of the receiving recess is tapered. Alternatively, an opening-side inner peripheral edge portion of the fitting groove may be tapered in any one or more of the other embodiments.

The present invention is not limited to the above embodiments and the modifications thereof discussed above, and the above embodiments may be further modified within the spirit and scope of the present invention.

What is claimed is:

1. A fuel injection valve comprising:

a housing that is configured into a tubular form;

a nozzle that is located at one end portion of the housing and includes a fuel injection hole and a valve seat;

a stationary core that is held in an inside of the housing and is configured into a tubular form;

a needle that is received in the housing and is adapted to reciprocate in an axial direction, wherein the needle includes:

a main body that is configured into an elongated rod form and has a sealing portion, which is formed at one end portion of the main body and is seatable against the valve seat; and a flange that radially outwardly extends from the other end portion of the main body, which is opposite from the one end portion of the main body, wherein the needle opens the fuel injection hole when the sealing portion is lifted away from the valve seat in an opening direction, and the needle closes the fuel injection hole when the sealing portion is seated against the valve seat in a closing direction, which is axially opposite from the opening direction;

a movable core that is axially placed between the stationary core and the nozzle in the inside of the housing and is adapted to reciprocate in the axial direction, wherein the movable core includes:

a through-hole that axially extends through the movable core and receives the main body of the needle therethrough; and a receiving recess that is axially recessed in a stationary core side end surface of the movable core located on an axial side where the stationary core is placed, wherein the receiving recess is configured into an annular form and radially outwardly extends from the through-hole to receive the flange of the needle;

a movable plate that is placed on an axial side of the movable core, which is opposite from the nozzle, wherein an outer diameter of the movable plate is larger than an inner diameter of the receiving recess, and the movable plate is contactable with the movable core and the needle;

a first urging member that urges the movable plate to urge the movable core in the closing direction;

a second urging member that has an urging force, which is smaller than an urging force of the first urging member, wherein the second urging member urges the movable core to urge the movable plate in the opening direction; and a coil that generates a magnetic force upon receiving an electric power to magnetically attract the movable core toward the stationary core side, wherein:

an axial length of the flange is smaller than an axial distance between a contact surface of the movable plate, which is contactable with the needle, and a bottom wall of the receiving recess in a contact state where the movable core and the movable plate contact with each other in the axial direction.

2. The fuel injection valve according to claim 1, wherein:

the movable core includes a fitting groove, which is formed in the stationary core side end surface of the movable core;

the fitting groove is configured into an annular form and radially outwardly extends from the receiving recess; and the fitting groove is adapted to receive the movable plate.

3. The fuel injection valve according to claim 1, wherein:

an outer diameter of the movable plate is larger than an inner diameter of the stationary core; and the movable plate is configured such that in the contact state where the movable core and the movable plate contact with each other, a stationary core side end surface of movable plate, which is located on an axial side where the stationary core is placed, is placed on an axial side of the stationary core side end surface of the movable core where the stationary core is located.

4. The fuel injection valve according to claim 1, wherein the movable core includes at least one primary hole, which connects between a bottom wall of the receiving recess and an outer wall of the movable core.

5. The fuel injection valve according to claim 1, wherein the movable plate includes at least one secondary hole, which is located in a contact area of the movable plate that is contactable with the flange and extends through the movable plate in a thickness direction of the movable plate.

6. The fuel injection valve according to claim 1, wherein an outer peripheral edge portion of the movable plate is tapered such that an outer diameter of the movable plate progressively increased from one axial side, at which the needle is located, toward the other axial side, at which the first urging member is located.

7. The fuel injection valve according to claim 1, wherein an inner peripheral edge portion, which is formed at an opening of the receiving recess in the stationary core side end surface of the movable core, is tapered such that an inner diameter of the inner peripheral edge portion progressively increases from one axial side where the bottom wall of the receiving recess is located toward the other axial side where the stationary core is located.

8. The fuel injection valve according to claim 1, wherein:

the needle includes an engaging portion, which is axially placed between the flange and the sealing portion and radially outwardly projects;

the second urging member is axially held between the movable core and the engaging portion; and the second urging member urges the movable core in the opening direction and urges the needle in the closing direction.

9. The fuel injection valve according to claim 1, wherein:

the movable plate is guided by an inner peripheral wall of the stationary core and has a receiving portion that is adapted to receive an end portion of the needle, at which the flange is formed; and the needle is guided by an inner peripheral wall of the receiving portion of the movable plate.

10. The fuel injection valve according to claim 1, wherein the movable plate is constructed such that an axial distance between an end surface of the movable plate, which is placed on an axial side where the first urging member is located, and the fuel injection hole is longer than an axial distance between an end surface of the stationary core, which is placed on a side where the movable core is located, and the fuel injection hole.

11. The fuel injection valve according to claim 1, wherein the movable plate is made of a hard material, which is harder than that of the movable core.

* * * * *